US005620227A

United States Patent [19]

Brune

[11] Patent Number: 5,620,227

[45] Date of Patent: Apr. 15, 1997

[54] VEST GARMENT WITH PIVOTABLE SEAT MEMBER

[76] Inventor: Paul W. Brune, 147 Samson La., New Haven, Mo. 63068

[21] Appl. No.: 625,753

[22] Filed: Mar. 29, 1996

[51] Int. Cl.[6] ..... A47C 1/00

[52] U.S. Cl. ..... 297/4; 297/380; 297/DIG. 6

[58] Field of Search ..... 297/4, 17, DIG. 6, 297/380, 382, 378.14, 226, 440.11; 224/155; 2/102, 1

[56] References Cited

U.S. PATENT DOCUMENTS

| | | | |
|---|---|---|---|
| 359,921 | 3/1887 | Cowan | 297/4 |
| 1,350,021 | 8/1920 | Holliday | 297/4 |
| 1,626,166 | 4/1927 | Stair | 297/4 X |
| 2,736,030 | 2/1956 | Moody | 297/4 X |
| 2,973,888 | 3/1961 | Beardsley . | |
| 3,093,407 | 6/1963 | Wilson | 297/4 |
| 3,185,362 | 5/1965 | Wakefield | 297/4 X |
| 4,720,029 | 1/1988 | Varanakis | 224/155 |
| 4,826,242 | 5/1989 | Trethewey | 297/17 |
| 4,846,528 | 7/1989 | Beier | 297/465 |
| 4,925,064 | 5/1990 | Comora | 297/4 X |
| 4,955,665 | 9/1990 | Richer | 297/4 |
| 5,016,792 | 5/1991 | Jay . | |
| 5,031,811 | 7/1991 | Charest . | |
| 5,031,960 | 7/1991 | Day | 297/465 X |
| 5,131,575 | 7/1992 | Charest . | |
| 5,222,641 | 6/1993 | Medeiros . | |
| 5,271,659 | 12/1993 | Zinkevicz | 297/4 |
| 5,335,882 | 8/1994 | Bonacci | 297/463.1 X |
| 5,381,941 | 1/1995 | Brune . | |

FOREIGN PATENT DOCUMENTS

| | | | |
|---|---|---|---|
| 155395 | 6/1932 | Switzerland | 297/4 |
| 590697 | 8/1947 | United Kingdom | 297/380 |
| 1185153 | 3/1970 | United Kingdom | 297/465 |

OTHER PUBLICATIONS

Bass Pro Shop, Fall 1993 Hunting Catalog pp. 23 and 116–117.

*Primary Examiner*—Milton Nelson, Jr.
*Attorney, Agent, or Firm*—Robbins & Robbins

[57] ABSTRACT

A vest garment with pivotable seat member is provided. The seat member is connected to the interior aspect of the dorsal member of the vest garment and is pivotable between positions for use and for stowing away. Straps support the seat member from the vest to create an effective chair when the seat member is lowered for use, and the straps are adjustable so that the angular orientation of the seat member with respect to the vest can be adjusted for comfort to the user. When not in use, the seat member is swung back inside the vest and stowed against the dorsal member. The dorsal portion of the vest fabric and the seat member are reinforced with rigid edges for seating comfort and structural support.

11 Claims, 4 Drawing Sheets

VEST GARMENT WITH PIVOTABLE SEAT MEMBER

BACKGROUND OF THE INVENTION

When one ventures forth into the outdoors, it is a logistical impossibility that every useful item can be carried along. Non-essential items are usually not taken along. Space and load considerations dictate what necessary items will be included. Such considerations have compelled the creation of many improved gear packs, clothing articles and pack frames, whose designs have been modified to increase their load carrying efficiency, such as the addition of larger, expandable pockets or larger frames.

However, even with such enhancements, there still is a finite limit as to what can be taken along. Beyond the staple items of survival, anything that is taken along must satisfy the user's essential needs. A means for allowing the user a place to sit is certainly desirable, but such means may be a burden to carry, or may be too large to stow away in a backpack.

There do exist devices which incorporate a built-in seat, for instance, my PIVOTABLE SEAT MEMBER FOR BACKPACK FRAME disclosed in U.S. Pat. No. 5,381,941. However, the user may not need or want an entire backpack frame. There also exist gear packs, without a frame, which can provide a built-in seat, for instance, my COMBINATION GEAR PACK AND PIVOTABLE SEAT MEMBER, disclosed in application Ser. No. 08/358,260, filed Dec. 19, 1994. However, a gear pack is generally situated on the back of the user, which requires the user to first take off the gear pack before the seat member can be utilized.

There exist a wide variety of hunting vests which come equipped with several pockets and pouches, and thus is a popular item not only for hunters, but also others who venture into the outdoors. They are generally lightweight and roomy, and allow for easy access to the front pockets. It would be desirable to incorporate a seat element into such types of garments.

SUMMARY OF THE INVENTION

By means of the instant invention there is provided a vest garment having a pivotable seat member. The vest garment is of the type commonly used for hunting, whose structure can approximate the conventional style of vest, or may have open shoulders to give more room and maneuverability to the user. A seat member is attached to a lower portion of the back, or dorsal, portion of the vest garment so that it may swing freely within the interior of the vest. Straps are provided so that the seat member may be suspended from the dorsal fabric of the vest to form a free-standing chair structure which is capable of supporting the user. The angular orientation of the seat in relation to the vest can be varied by adjusting the length of the support straps. The longitudinal margin edges of the seat member and the dorsal fabric of the vest have rigid internal frames to give supportive strength to the seat.

The seat member is swung up and held in engagement against the inside dorsal portion of the vest for storage when not in use. It can be released and brought down for assembly into the chair mode without having to first remove the vest.

It is therefore an object of this invention to provide a vest garment having a seat member which can enable the vest to be utilized as a free-standing chair.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
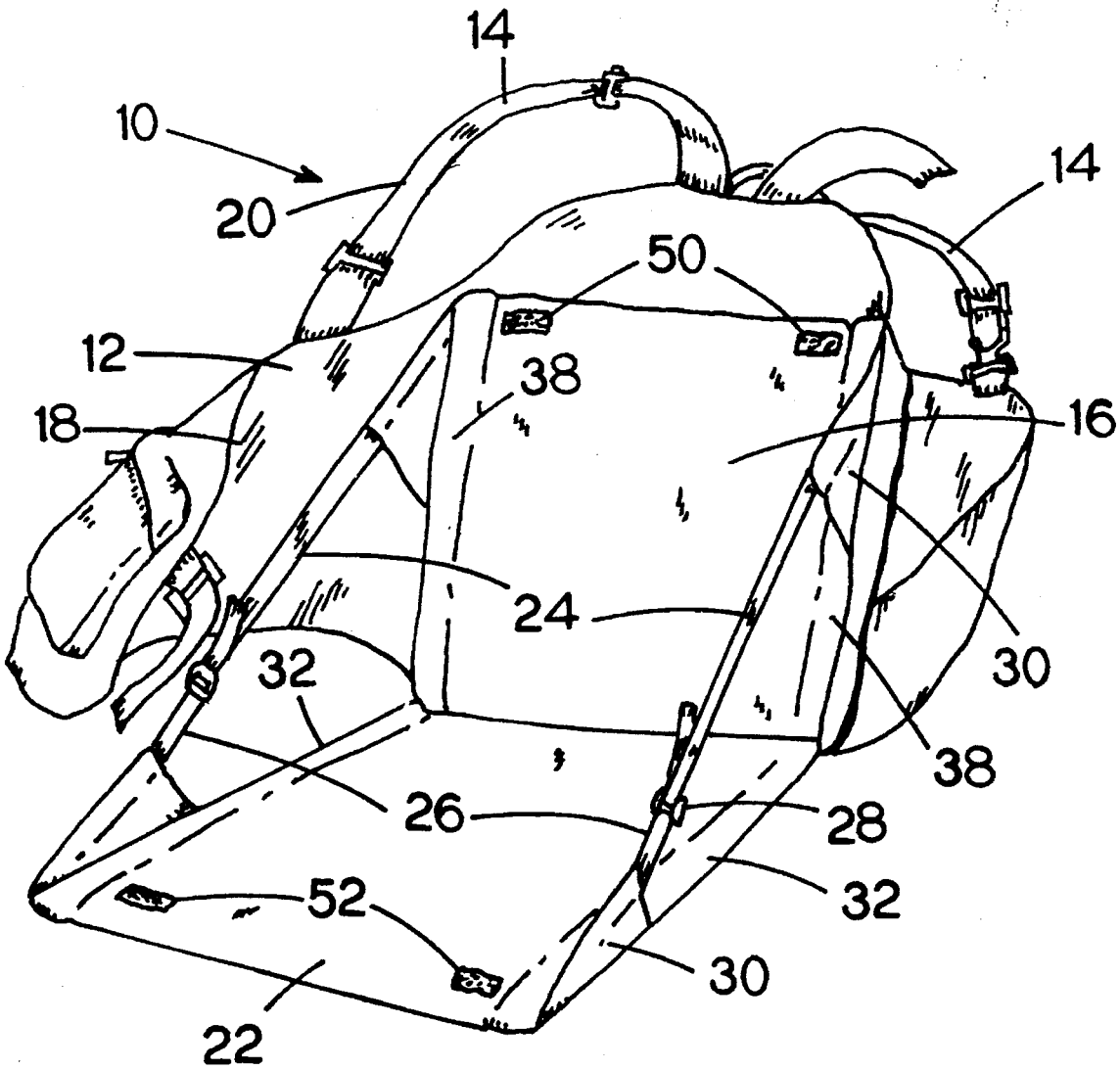
FIG. 1 is a perspective view of the vest with the seat member swung down into position for use.
Figure 2:
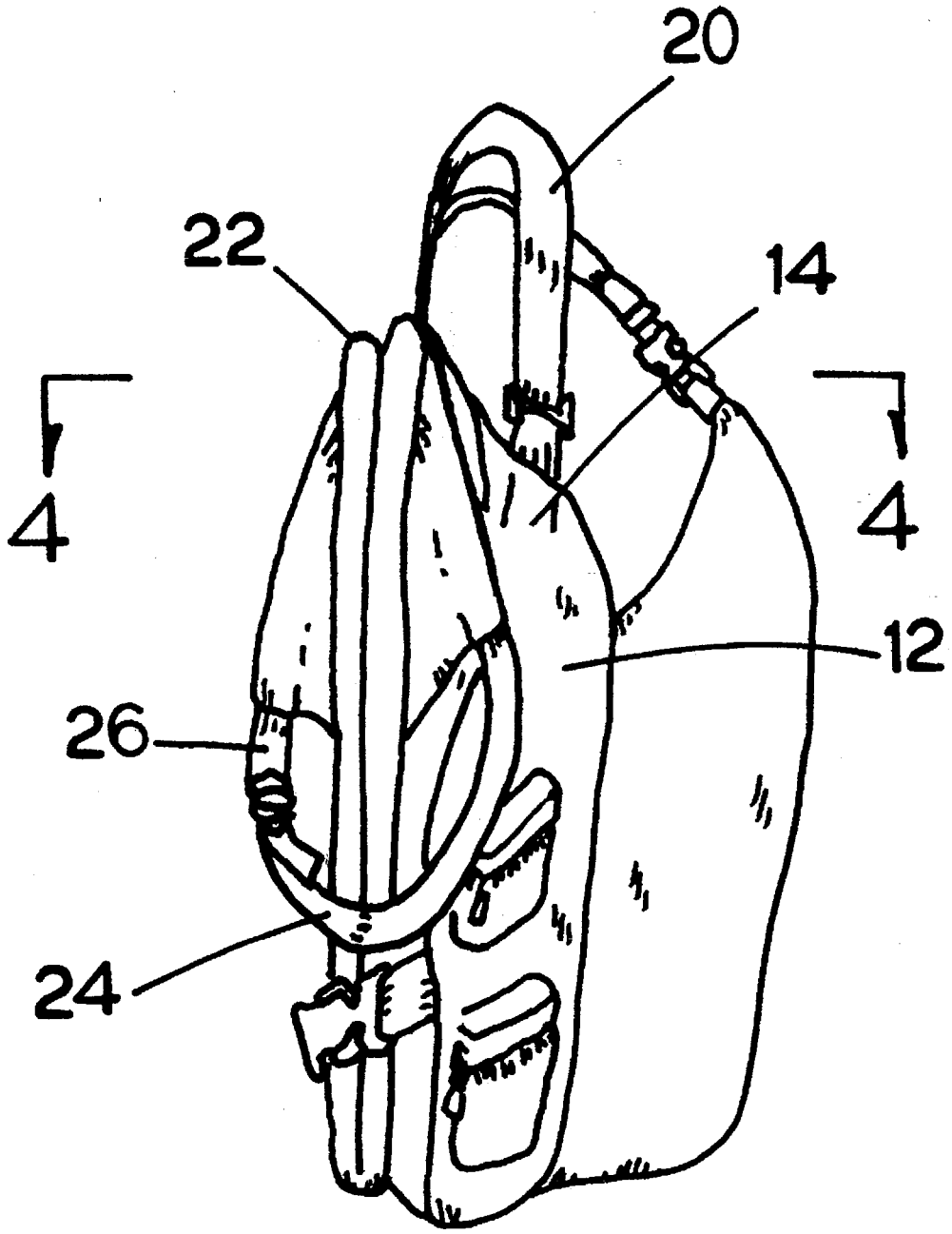
FIG. 2 is a view in side elevation from the side showing the seat member folded up against the inside of the vest in a stowed position.
Figure 3:
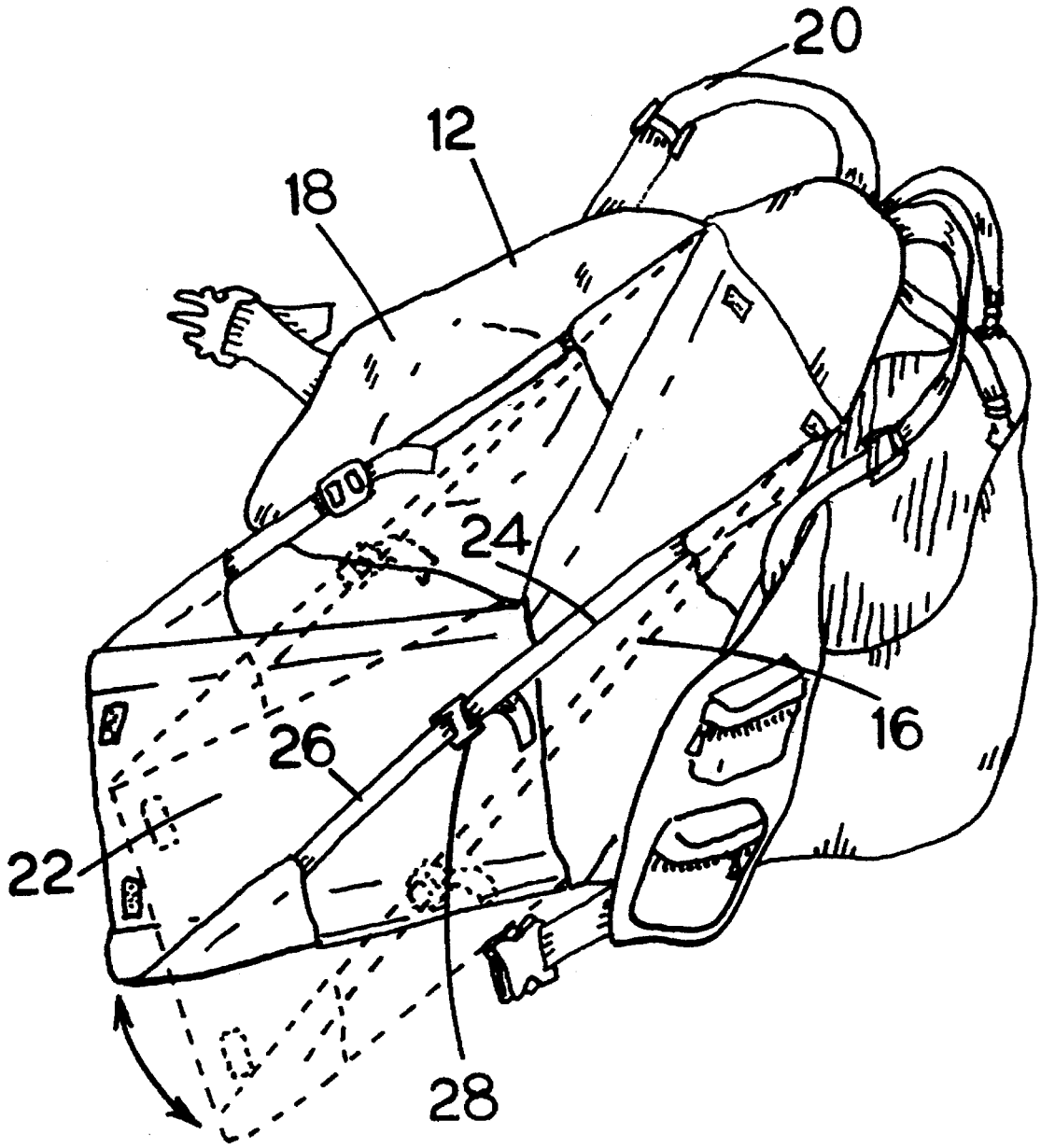
FIG. 3 is a perspective view showing a range over which the seat member may be adjusted.

The combination vest garment with pivotable seat member is generally indicated by the reference numeral 10 as shown in FIG. 1. It is comprised of a vest member 12, commonly of the type used for hunting, and has shoulder supports 14, a dorsal member 16 and front blouse members 18. Shoulder supports 14 may be constructed of an integral fabric piece, or may be comprised merely of shoulder straps 20 as shown in FIG. 1. The straps provide more shoulder room for the user and also allow for good ventilation. Seat member 22 is comprised of a generally rectangular fabric web of canvas or other suitable material. It is connected along a proximate edge to the interior aspect of dorsal member 16 of the vest garment as shown in FIG. 1. For strength, the connection of seat member 22 to the vest along this area is made by sewing and stitching. Alternately, the connection may comprise zipper means so that the seat member may be removeable. This connection allows for pivotable movement of seat member 22 over a range from a position of stowed engagement with the interior aspect of dorsal member 16 of the vest garment as shown in FIG. 2, to positions away from the dorsal member to create an effective chair as shown in FIGS. 1 and 3.

Support straps 24 are affixed to vest 12 and connect with straps 26 which are affixed to seat member 22. Quick connect/disconnect buckles 28 are used for easy connection and release. These buckles also allow straps 24 to be lengthened or drawn shorter so that the angular distance between seat member 22 and dorsal member 16 of the vest can be adjusted as seen in FIG. 3. The respective straps of vest 12 and seat member 22 can each be affixed at their base to fabric flaps 30 for sturdiness and flexibility as shown in FIG. 1. The seat member can be held against the dorsal member of the vest in a stowed position as seen in FIG. 2 by means of VELCRO®-type hook and loop fastening material tabs 50 and 52 placed on seat member 22 and dorsal member 16, respectively. In this fashion, seat member 22 can be quickly and easily released from its stowed engagement and brought down for erection of the chair.

Figure 4:
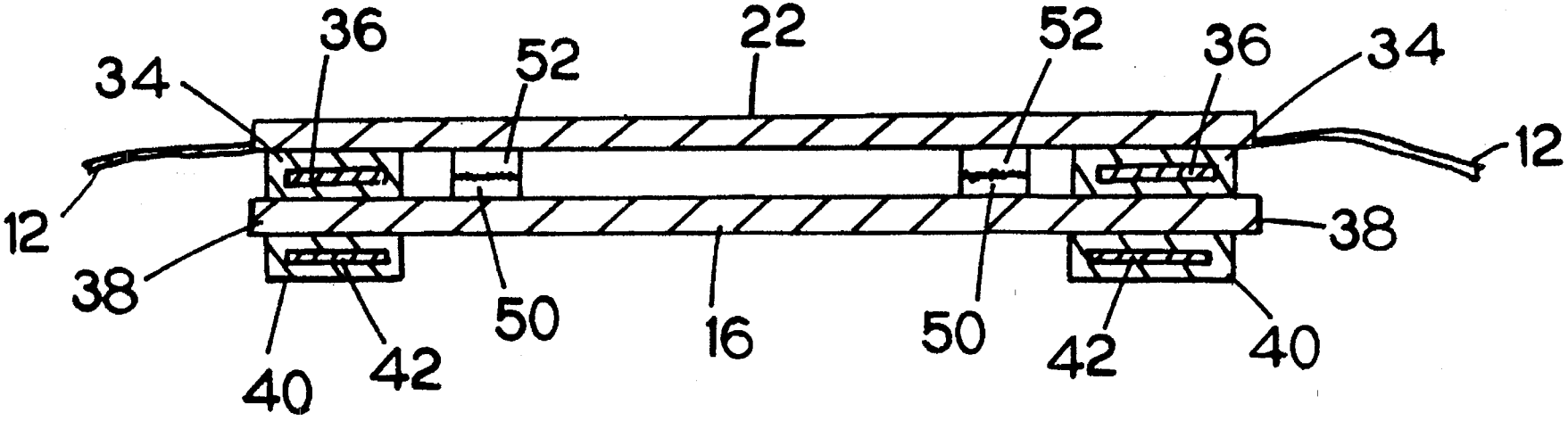
FIG. 4 is a top plan cross-sectional view of the vest and seat member taken along line 4—4 of FIG. 2.

For structural support, the outer lateral marginal edges 32 of seat member 22 can be made to be rigid. One suitable embodiment features providing seat member 22 with longitudinal pockets 34 which receive elongated rigid members 36 as seen in FIG. 4. These pockets can be located either externally or internally of seat member 22. Likewise, the lateral outer marginal edges 38 of the dorsal member 16 of the vest can also be made to be rigid. A suitable embodiment similarly features providing dorsal member 16 with longitudinal pockets 40 which receive elongated rigid members 42 as seen in FIG. 4. These pockets can similarly be provided externally of the vest fabric or integrated directly therein.

USE

The inventive vest garment and pivotable seat member is easily employed by a user to convert a hunter's type vest into an effective stand-alone chair. The vest can be easily converted into the chair as shown in FIGS. 1 and 3 by merely releasing seat member 22 from its stored position against dorsal member 16, pivoting the seat member to a desired position, then fastening straps 24 to straps 26. It should be noted that straps 24 and 26 need not ever be separated at any time when the seat member is attached to the vest. Buckles 28 enable the connective length of the straps to be adjusted so that the angular distance between dorsal member 16 of the vest and seat member 22 can be varied for suitable user comfort. While any chair angle can be attained, the maximum seat effectiveness is reached between the angle range of about 90° to 135°. The erected chair can then be placed on any seating surface, whether it be standing alone on the ground, placed on a flat bleacher seat, or even nestled into an existing seat or chair.

User comfort is enhanced by virtue of the rigid members placed in the marginal edges of both the seat member and the dorsal region of the vest. Padding can also be added throughout the seat member and vest and they can be made to be waterproof. The back angle is easily adjusted as desired by the user by manipulation of the straps, and the seat can be erected even while the user is wearing the vest, without the need for first removing the vest.

Various changes and modifications may be made within this invention as will be apparent to those skilled in the art. Such changes and modifications are within the scope and teaching of this invention as defined in the claims appended hereto.

What is claimed is:

1. A combination vest and pivotable seat member, said vest comprising a fabric to be worn on an upper torso of a user, said vest comprising at least a dorsal member and shoulder support means, said seat member having one end connected to a lower portion of said dorsal member and having straps for being connected to and supported from an upper portion of said dorsal member whereby an effective chair comprised of said seat member and said dorsal member for supporting said user is created, lengths of said straps being adjustable, whereby an angular orientation between said seat member and said dorsal member is adjustable.

2. The combination of claim 1 in which said seat member is pivotable between a stowage position wherein said seat member is brought into engagement with said dorsal member, and a position of use wherein said seat member is disposed within a range between around 90° to 135° from said dorsal member.

3. The combination of claim 1 in which said seat member and said dorsal member are padded.

4. The combination of claim 1 in which outer longitudinal side margins of said seat member and outer longitudinal side margins of said dorsal member are rigid.

5. The combination of claim 1 in which said seat member and said dorsal member each have pockets along longitudinal side margins thereof for removably receiving rigid members.

6. The combination of claim 1 in which said seat member is comprised of waterproof fabric.

7. The combination of claim 1 in which said seat member has means for being held in adjacent engagement with said dorsal member, whereby said seat member may be stowed away when not in use.

8. The combination of claim 7 in which said means for holding said seat member against said dorsal member comprises hook and loop mating strips disposed on said seat member and said dorsal member.

9. The combination of claim 1 in which means for supporting said seat member from said dorsal member comprise said straps connecting said seat member to said dorsal member, whereby said seat member is pivotable between a stowage position wherein said seat member is brought into engagement with said dorsal member, and a position of use wherein said seat member is disposed within a range between around 90° to 135° from said dorsal member, said seat member having means for being held in adjacent engagement with said dorsal member, whereby said seat member may be stowed away when not in use.

10. The combination of claim 9 in which said seat member and said dorsal member are padded, and outer longitudinal side margins of said seat member and outer longitudinal side margins of said dorsal member are rigid.

11. The combination of claim 10 in which said seat member and said dorsal member each have pockets along said longitudinal side margins thereof for removably receiving rigid members.

* * * * *